US010777162B2

(12) United States Patent
Kim et al.

(10) Patent No.: US 10,777,162 B2
(45) Date of Patent: Sep. 15, 2020

(54) DISPLAY APPARATUS AND METHOD OF DRIVING DISPLAY PANEL THEREOF

(71) Applicant: SAMSUNG DISPLAY CO., LTD., Yongin-si, Gyeonggi-Do (KR)

(72) Inventors: Kang-Woo Kim, Seoul (KR); Beomjun Kim, Seoul (KR); Changjung Kim, Yongin-si (KR); Seongyeol Syn, Asan-si (KR); Gwon-Heon Ryu, Cheonan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 16/230,582

(22) Filed: Dec. 21, 2018

(65) Prior Publication Data

US 2019/0206356 A1 Jul. 4, 2019

(30) Foreign Application Priority Data

Dec. 29, 2017 (KR) ..... 10-2017-0184256

(51) Int. Cl.
*G09G 3/36* (2006.01)
*G09G 3/20* (2006.01)

(52) U.S. Cl.
CPC ..... *G09G 3/3696* (2013.01); *G09G 3/20* (2013.01); *G09G 3/2003* (2013.01);
(Continued)

(58) Field of Classification Search
CPC ..... G09G 2340/0435; G09G 2310/08; G09G 3/20; G09G 3/3614; G09G 3/3688;
(Continued)

(56) References Cited

U.S. PATENT DOCUMENTS 9,182,805 B2 11/2015 Kim et al.
9,478,184 B2 * 10/2016 Choi ..... G09G 3/3655
(Continued)

FOREIGN PATENT DOCUMENTS

KR 1020120072558 7/2012
KR 10-1463617 11/2014
(Continued)

*Primary Examiner* — Dismery Mercedes
(74) *Attorney, Agent, or Firm* — F. Chau & Associates, LLC

(57) ABSTRACT

A display apparatus includes a display panel, a timing controller, a data driver and a voltage generator. The display panel includes a switching element, a pixel electrode connected to the switching element, a common electrode, a storage electrode and a pixel electrode. The timing controller processes input image data according to a variable frame rate and generates a data signal having a variable frame length. The data driver converts the data signal into a data voltage and outputs the data voltage to the pixel electrode. The voltage generator may apply a common voltage to the common electrode and a storage voltage greater than the common voltage to the storage electrode, and/or apply the common voltage varied according to a grayscale value of the input image data. Embodiments may reduce or obviate a display defect caused by luminance differences between frames displayed at different frame rates.

23 Claims, 11 Drawing Sheets

(52) U.S. Cl.
CPC ..... *G09G 3/3607* (2013.01); *G09G 3/3614* (2013.01); *G09G 3/3655* (2013.01); *G09G 3/3688* (2013.01); *G09G 2300/0426* (2013.01); *G09G 2310/027* (2013.01); *G09G 2310/08* (2013.01); *G09G 2320/0233* (2013.01); *G09G 2320/0242* (2013.01); *G09G 2320/0271* (2013.01); *G09G 2320/0276* (2013.01)

(58) Field of Classification Search
CPC .. G09G 3/3696; G09G 3/3648; G09G 3/3655; G09G 3/3291; G09G 3/2003; G09G 3/2007; G09G 3/3607; G09G 3/36; G09G 2320/0276; G09G 2320/0271; G09G 2320/0233; G09G 2320/0242; G09G 2340/0428; G09G 5/18
See application file for complete search history.

(56) References Cited

U.S. PATENT DOCUMENTS 9,799,280 B2 * 10/2017 Shin ..... G09G 3/3607
9,959,802 B1 * 5/2018 Jiang ..... G09G 3/3685
10,453,418 B2 * 10/2019 Lim ..... G09G 3/3685
2005/0248557 A1 * 11/2005 Miyazawa ..... G09G 3/2025 345/204
2009/0015741 A1 * 1/2009 Kim ..... G02F 1/1343 349/33
2009/0167659 A1 * 7/2009 Kim ..... G09G 3/3655 345/89
2010/0001988 A1 * 1/2010 Kim ..... G09G 3/3614 345/214
2010/0033414 A1 * 2/2010 Jeong ..... G09G 3/3655 345/89
2012/0182282 A1 * 7/2012 van Veenendaal ..... G09G 3/344 345/212
2012/0218317 A1 * 8/2012 Choi ..... G09G 3/3655 345/690
2015/0213769 A1 * 7/2015 Shin ..... G09G 3/3607 345/690
2015/0243204 A1 * 8/2015 Park ..... G09G 3/3688 345/212
2016/0343317 A1 * 11/2016 Syu ..... G09G 3/3614
2016/0351142 A1 * 12/2016 Ouyang ..... G09G 3/3614
2017/0076649 A1 * 3/2017 Kim ..... G09G 3/36
2019/0005862 A1 * 1/2019 Zhang ..... G09G 3/20

FOREIGN PATENT DOCUMENTS

KR 10-2017-0064261 6/2017
KR 1020170076478 7/2017

* cited by examiner

DISPLAY APPARATUS AND METHOD OF DRIVING DISPLAY PANEL THEREOF

PRIORITY STATEMENT

This application claims priority under 35 U.S.C. § 119 to Korean Patent Application No. 10-2017-0184256, filed on Dec. 29, 2017 in the Korean Intellectual Property Office KIPO, the contents of which are incorporated by reference herein in its entirety.

BACKGROUND

1. Field

This disclosure relates generally to a display apparatus and more particularly to a method of driving a display panel thereof at a variable frame rate with reduced visual artifacts.

2. Discussion of the Related Art

A display apparatus typically includes a display panel and a display panel driver. The display panel driver may include a timing controller, a gate driver and a data driver. The timing controller adjusts driving timings of the gate driver and the data driver. The gate driver outputs gate signals to gate lines. The data driver outputs data voltages to data lines.

A graphic processing unit (GPU) which provides input image data to the timing controller may provide the input image data in a variable frame rate. Power consumption in the display apparatus may be reduced for relatively low frame rate video. Thus, a technique of dynamically lowering the frame rate when a video changes from a high motion scene to a low motion scene may result in a power savings. The timing controller processes the input image data synchronized in the variable frame rate.

When the display panel displays video at a variable frame rate, luminance of the video images may change between frames displayed at different frame rates. This change in luminance may cause a display defect which is visually perceptible to a viewer.

SUMMARY

Exemplary embodiments of the present inventive concept provide a display apparatus capable of compensating a display defect due to a variable frame rate.

Exemplary embodiments of the present inventive concept also provide a method of driving a display panel using the above-mentioned display apparatus.

In an exemplary embodiment of a display apparatus according to the present inventive concept, the display apparatus includes a display panel, a timing controller, a data driver and a voltage generator. The display panel includes a switching element; a pixel electrode connected to the switching element; a common electrode; and a storage electrode; where the pixel electrode overlaps both the common electrode and the storage electrode in a common direction. The timing controller processes input image data according to a variable frame rate and generates a data signal from the input image data having a variable frame length. The data driver converts the data signal into a data voltage and outputs the data voltage to a data line connected to the switching element. The voltage generator applies a common voltage to the common electrode and a storage voltage greater than the common voltage to the storage electrode.

In an exemplary embodiment, the data signal may include an active period and a blank period. The timing controller may adjust a length of the blank period of the data signal according to the variable frame rate.

In an exemplary embodiment, the timing controller may generate a first frame data signal including a first active period and a first blank period corresponding to a first frame rate. The timing controller may generate a second frame data signal including a second active period having a length equal to a length of the first active period and a second blank period having a length less than a length of the first blank period corresponding to a second frame rate greater than the first frame rate.

In an exemplary embodiment, the storage voltage may be about twice the common voltage.

In an exemplary embodiment, the voltage generator may generate the common voltage varied according to a grayscale value of the input image data.

In an exemplary embodiment, a first average of the common voltage, when the grayscale value of the input image data is between a minimum grayscale value and a mid-range grayscale value, may be less than a second average of the common voltage, when the grayscale value of the input image data is between the mid-range grayscale value and a maximum grayscale value.

In an exemplary embodiment, the voltage generator may generate the common voltage varied according to an average grayscale value of the input image data in a frame.

In an exemplary embodiment, the voltage generator may generate the storage voltage varied according to a grayscale value of the input image data.

In an exemplary embodiment, a first average of the storage voltage, when the grayscale value of the input image data is between a minimum grayscale value and a mid-range grayscale value, may be greater than a second average of the storage voltage, when the grayscale value of the input image data is between the mid-range grayscale value and a maximum grayscale value.

In an exemplary embodiment, the voltage generator may generate the storage voltage varied according to an average grayscale value of the input image data in a frame.

In an exemplary embodiment, the display apparatus may further include a gamma reference voltage generator which generates a gamma reference voltage having a value corresponding to a level of the data signal. The gamma reference voltage generator may generate a positive gamma reference voltage and a negative gamma reference voltage such that an average of the positive gamma reference voltage and the negative gamma reference voltage is a center voltage for the same grayscale value. The gamma reference voltage generator may generate the positive gamma reference voltage and the negative gamma reference voltage based on the center voltage varied according to a grayscale value of the input image data.

In an exemplary embodiment, a first average of the center voltage, when the grayscale value is between a minimum grayscale value and a mid-range grayscale value, may be less than a second average of the center voltage, when the grayscale value is between the mid-range grayscale value and a maximum grayscale value.

In an exemplary embodiment, the timing controller may generate a variable frame compensating signal varied according to a grayscale value of the input image data. The timing controller may add the variable frame compensating signal to the grayscale value of the input image data.

In an exemplary embodiment, the variable frame compensating signal may have a negative value. A first average of an absolute value of the variable frame compensation signal, when the grayscale value is between a minimum grayscale value and a mid-range grayscale value, may be greater than a second average of the absolute value of the variable frame compensation signal, when the grayscale value is between the mid-range grayscale value and a maximum grayscale value.

In an exemplary embodiment of a display apparatus according to the present inventive concept, the display apparatus includes a display panel, a timing controller, a data driver and a voltage generator. The display panel includes a switching element, a pixel electrode connected to the switching element and a common electrode having a major surface overlapping a major surface of the pixel electrode. The timing controller processes input image data according to a variable frame rate and generates therefrom a data signal having a variable frame length. The data driver converts the data signal into a data voltage and outputs the data voltage to a data line connected to the switching element. The voltage generator applies a common voltage varied according to a grayscale value of the input image data to the common electrode.

In an exemplary embodiment, a first average of the common voltage, when the grayscale value of the input image data is between a minimum grayscale value and a mid-range grayscale value, may be less than a second average of the common voltage, when the grayscale value of the input image data is between the mid-range grayscale value and a maximum grayscale value.

In an exemplary embodiment, the voltage generator may generate the common voltage varied according to an average grayscale value of the input image data in a frame.

In an exemplary embodiment of a method of driving a display panel according to the present inventive concept, the method includes processing input image data according to a variable frame rate and generating a data signal having a variable frame length, converting the data signal into a data voltage and outputting the data voltage to a pixel electrode of the display panel via a data line and a switching element, applying a common voltage to a common electrode of the display panel and applying a storage voltage greater than the common voltage to a storage electrode of the display panel.

In an exemplary embodiment, the data signal may include an active period and a blank period. The generating the data signal may include adjusting a length of the blank period of the data signal according to the variable frame rate.

In an exemplary embodiment, the generating the data signal may include generating a first frame data signal including a first active period and a first blank period corresponding to a first frame rate and generating a second frame data signal including a second active period having a length equal to a length of the first active period and a second blank period having a length less than a length of the first blank period corresponding to a second frame rate greater than the first frame rate.

In an exemplary embodiment, the method may further involve computing an average grayscale value of a frame to be displayed; and setting the common voltage for the frame according to the average grayscale value, where the common voltage is set to a value sufficient to reduce or minimize a difference in luminance according to the average grayscale value generated in positive polarity vs. negative polarity driving conditions.

In an exemplary embodiment, the method may further involve computing an average grayscale value of a frame to be displayed; and setting the storage voltage for the frame according to the average grayscale value, where the storage voltage is set to a value sufficient to reduce or minimize a difference in luminance according to the average grayscale value generated in positive polarity vs. negative polarity driving conditions.

In an exemplary embodiment, the storage voltage is applied at a value sufficient to minimize a luminance difference between frames of different frame lengths.

According to an exemplary embodiment of the display apparatus and the method of driving the display panel using the display apparatus, the image is displayed using a storage voltage greater than a common voltage so that a display defect due to the variable frame rate may be compensated.

In addition, in an exemplary embodiment, the common voltage has a varied value according to a grayscale value of the input image data so that the display defect due to the variable frame rate may be compensated.

Thus, the display quality of the display panel displaying the image in the variable frame rate may be enhanced.

BRIEF DESCRIPTION OF THE DRAWINGS

The above and other features and advantages of the present inventive concept will become more apparent by describing in detailed exemplary embodiments thereof with reference to the accompanying drawings, in which like reference numerals denote like elements or features, wherein.

DETAILED DESCRIPTION OF EMBODIMENTS

Hereinafter, embodiments of the present inventive concept will be explained in detail with reference to the accompanying drawings.

Figure 1:
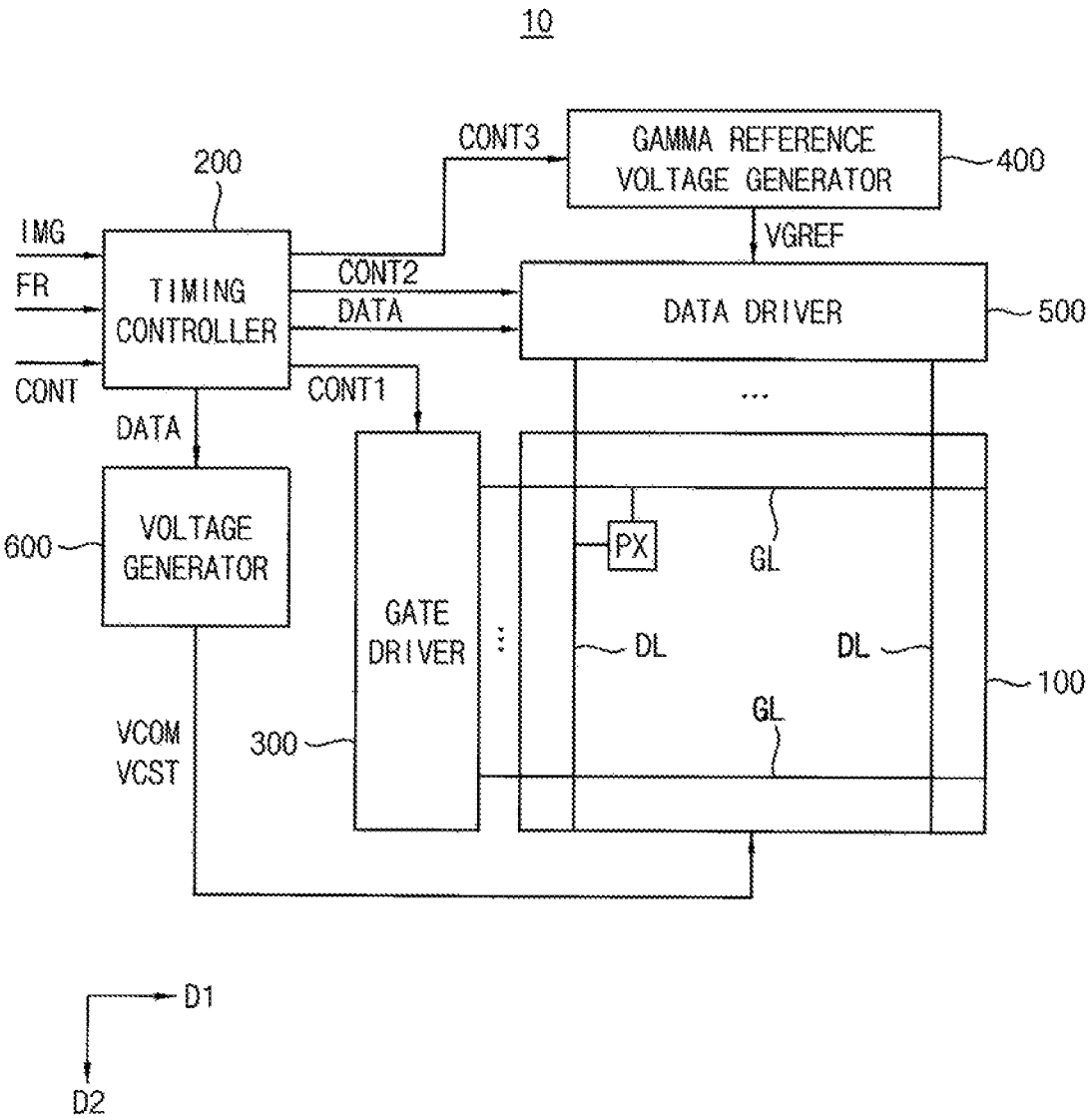
FIG. 1 is a block diagram illustrating a display apparatus according to an exemplary embodiment of the present inventive concept.

FIG. 1 is a block diagram illustrating a display apparatus, 10, according to an exemplary embodiment of the present inventive concept. Display apparatus 10 includes a display panel 100 and a display panel driver. The display panel driver includes a timing controller 200, a gate driver 300, a gamma reference voltage generator 400, a data driver 500 and a voltage generator 600.

The display panel 100 includes a display region and a peripheral region adjacent to the display region. For example, the display panel 100 may be a liquid crystal display panel including a liquid crystal layer.

The display panel 100 includes a plurality of gate lines GL, a plurality of data lines DL and a plurality of pixels PX electrically connected to the gate lines GL and the data lines DL. The gate lines GL extend in a first direction D1 and the data lines DL extend in a second direction D2 crossing the first direction D1.

The timing controller 200 receives input image data IMG and an input control signal CONT from an external device (not shown). The input image data IMG may include red image data, green image data and blue image data. In other examples, different color combination schemes may be used, such as a yellow, cyan and magenta scheme. The input control signal CONT may include a master clock signal and a data enable signal. The input control signal CONT may further include a vertical synchronizing signal and a horizontal synchronizing signal.

For example, the external device may be a graphic processing unit (GPU). The timing controller 200 may further receive a frame rate FR from the graphic processing unit. The frame rate FR may be a repetition rate for a current set of frames of video to be displayed. The frame rate FR may vary according to time. For instance, it may be desirable to display a first set of successive frames having a typical or high amount of motion at a frame rate FR of K frames/sec, but to display a second set of consecutive frames determined to have less motion at a lower frame rate. In some cases, when displaying video of a relatively static scene at a lower frame rate than that of a higher motion scene, the lower frame rate may be imperceptible to a user, and may advantageously consume less power in the display apparatus 10.

The timing controller 200 generates a first control signal CONT1, a second control signal CONT2, a third control signal CONT3 and a data signal DATA based on the input image data IMG, the frame rate FR and the input control signal CONT.

The timing controller 200 generates the first control signal CONT1 for controlling an operation of the gate driver 300 based on the frame rate FR and the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the frame rate FR and the input control signal CONT, and outputs the second control signal CONT2 to the data driver 500. The second control signal CONT2 may include a horizontal start signal and a load signal.

The timing controller 200 generates the data signal DATA based on the frame rate FR and the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. For example, the gate driver 300 may sequentially output the gate signals to the gate lines GL.

The gate driver 300 may be directly mounted on the display panel 100 or may be connected to the display panel 100 in a type of a tape carrier package ("TCP"). Alternatively, the gate driver 300 may be integrated in the peripheral region of the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The voltage generator 600 generates a common voltage VCOM and a storage voltage VCST. The voltage generator 600 outputs the common voltage VCOM and the storage voltage VCST to the display panel 100. The voltage generator 600 may generate the common voltage VCOM and the storage voltage VCST at values which are set based on the data signal DATA. For example, the voltage generator 600 may generate the common voltage VCOM and the storage voltage VCST according to a grayscale value of the data signal DATA. The voltages VCOM and VCST may be each determined on a frame to frame basis. For example, an average grayscale value for a given frame may be determined beforehand, and the voltages VCOM and VCST may each be set for that frame based on the average grayscale value. As explained later, this technique may reduce undesirable frame to frame luminance variation, particularly between frames of different lengths (or rates). Each of the common voltage VCOM and the storage voltage VCST set for a frame may be commonly applied to all the pixels of the display panel.

Figure 2:
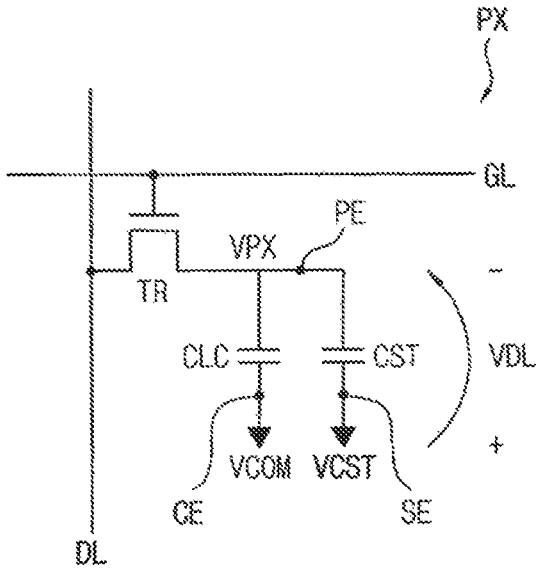
FIG. 2 is a circuit diagram illustrating an example pixel of FIG. 1.

FIG. 2 is a circuit diagram illustrating an example pixel PX of FIG. 1. As illustrated in FIGS. 1 and 2, the pixel PX includes a switching element TR, a pixel electrode PE connected to the switching element TR, a common electrode CE that overlaps the pixel electrode PE and a storage electrode SE that overlaps the pixel electrode. (Herein, overlapping of two electrodes refers to either a partial overlapping or complete overlapping of major surfaces of the electrodes.) Such overlapping of the pixel electrode with both the storage electrode SE and the common electrode may be an overlap in a common direction, such as in the horizontal direction for a vertically oriented stacked structure. In other words, the pixel electrode, the common electrode, and storage electrode may be disposed in different respective layers or substrates of a stacked structure, with at least portions of major surfaces thereof facing one another, e.g. in the vertical direction, and overlapping in the horizontal direction. Examples of such arrangements include a Twisted Nematic (TN) mode or a Vertical Alignment (VA) mode of an LCD.

A control electrode of the switching element TR may be connected to the gate line GL. An input electrode of the switching element TR may be connected to the data line DL. An output electrode of the switching element TR may be connected to the pixel electrode. Hereafter, the switching element TR is exemplified as a metal oxide semiconductor field effect transistor (MOSFET), where the control electrode, input electrode and output electrode may be the gate, source and drain electrodes, respectively, of the MOSFET.

The data driver 500 outputs the data voltage to the pixel electrode. A voltage of the data voltage corresponding to the pixel may hereafter be called a pixel voltage VPX.

The voltage generator 600 outputs the common voltage VCOM to the common electrode CE. The voltage generator 600 outputs the storage voltage VCST to the storage electrode SE.

A liquid crystal layer may be disposed between the pixel electrode and the common electrode. The overlapping portions of the pixel electrode PE and the common electrode CE, and the liquid crystal therebetween form a liquid crystal capacitor CLC. When the data signal DATA is applied to the pixel electrode PE and the common voltage VCOM is applied to the common electrode CE, the alignment of liquid crystal molecules of the liquid crystal capacitor CLC may be changed by an electric field generated in the liquid crystal layer. The adjustment in liquid crystal molecules adjusts the amount of light transmitted through the liquid crystal layer or blocks the transmission of light.

The overlapping portions of the pixel electrode PE and the storage electrode SE and the material therebetween (e.g. a gate insulating layer) form a storage capacitor CST. Thus, first and second ends of the storage capacitor CST are connected to the pixel electrode PE and the storage electrode SE, respectively. The storage capacitor CST may sustain a current data signal's voltage that charges the liquid crystal capacitor CLC, until the capacitor CLC is charged with a subsequent data signal. A gate insulating layer may be disposed between the pixel electrode and the storage electrode. A delta voltage VDL may be defined as a voltage across opposite ends of the storage capacitor CST, from the storage electrode SE to the pixel electrode PE. An example structure of the storage capacitor CST is explained referring to FIGS. 4, 5A and 5B in detail.

Figure 3:
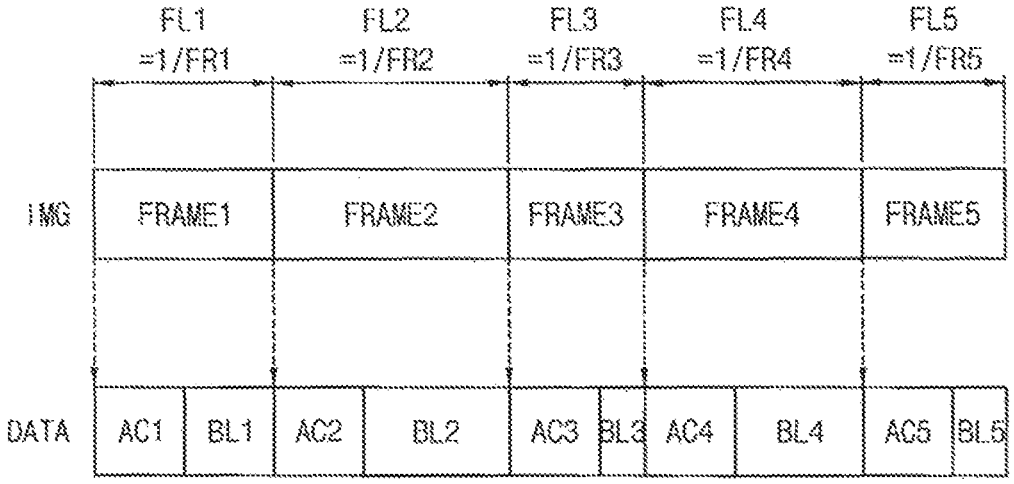
FIG. 3 is a conceptual diagram illustrating image processing of a timing controller of FIG. 1.

FIG. 3 is a conceptual diagram illustrating an image processing sequence of the timing controller 200 of FIG. 1. In this example, the graphic processing unit may output the input image data IMG having a variable frame rate FR. The timing controller 200 processes the input image data IMG according to the variable frame rate FR so that the timing controller 200 may generate the data signal DATA having a variable frame length FL=1/FR.

In the example shown, five frames FRAME 1-FRAME 5 may each have a different frame rate FR1, FR2, FR3, FR4 and FR5 and a different corresponding frame length FL1, FL2, FL3, FL4 and FL5. Although these frames of different lengths (i.e. different time durations) are shown contiguously to explain an aspect of the inventive concept, in a typical video scenario, several or many frames at the same frame rate may be displayed successively before the frame rate changes. The data signal DATA may include active periods AC1, AC2, AC3, AC4 and AC5 and associated blank periods BL1, BL2, BL3, BL4 and BL5. Each active period AC1, AC2, AC3, AC4 and AC5 is a period when the data signal DATA has grayscale data. Each blank period BL1, BL2, BL3, BL4 and BL5 is a period when the data signal DATA does not have the grayscale data. For example, each active period AC1, AC2, AC3, AC4 and AC5 may correspond to a scanning period of the gate signal. Each blank period BL1, BL2, BL3, BL4 and BL5 may correspond to a non-scanning period of the gate signal.

The timing controller 200 may adjust a length of the blank period BL1, BL2, BL3, BL4 and BL5 of the data signal DATA according to the variable frame rate FR (note the different lengths shown in FIG. 3). In contrast, as illustrated in FIG. 3, the timing controller 200 may maintain a length of the active period AC1, AC2, AC3, AC4 and AC5 of the data signal DATA at a same predetermined length despite the variable frame rate FR. The timing controller 200 may determine the length of the active periods AC1, AC2, AC3, AC4 and AC5 based on a maximum frame rate of the input image data IMG.

In FIG. 3, the timing controller 200 may generate a first frame data signal having a first active period AC1 and a first blank period BL1 corresponding to a first frame FRAME1 having a first frame rate.

The timing controller 200 may generate a second frame data signal having a second active period AC2 and a second blank period BL2 corresponding to a second frame FRAME2 having a second frame rate. For example, the second frame rate may be less than the first frame rate. A length of the second active period AC2 may be equal to a length of the first active period AC1. A length of the second blank period BL2 may be greater than a length of the first blank period BL1.

The timing controller 200 may generate a third frame data signal having a third active period AC3 and a third blank period BL3 corresponding to a third frame FRAME3 having a third frame rate. For example, the third frame rate may be greater than the first frame rate. A length of the third active period AC3 may be equal to the length of the first active period AC1. A length of the third blank period BL3 may be less than the length of the first blank period BL1.

The timing controller 200 may generate a fourth frame data signal having a fourth active period AC4 and a fourth blank period BL4 corresponding to a fourth frame FRAME4 having a fourth frame rate. For example, the fourth frame rate may be less than the first frame rate. A length of the fourth active period AC4 may be equal to the length of the first active period AC1. A length of the fourth blank period BL4 may be greater than the length of the first blank period BL1.

The timing controller 200 may generate a fifth frame data signal having a fifth active period AC5 and a fifth blank period BL5 corresponding to a fifth frame FRAME5 having a fifth frame rate. For example, the fifth frame rate may be greater than the first frame rate. A length of the fifth active period AC5 may be equal to the length of the first active period AC1. A length of the fifth blank period BL5 may be less than the length of the first blank period BL1.

As explained above, the timing controller 200 processes the input image data IMG according to the variable frame rate FR. The timing controller 200 may generate the data signal DATA having the variable frame length according to the variable frame rate FR.

Figure 4:
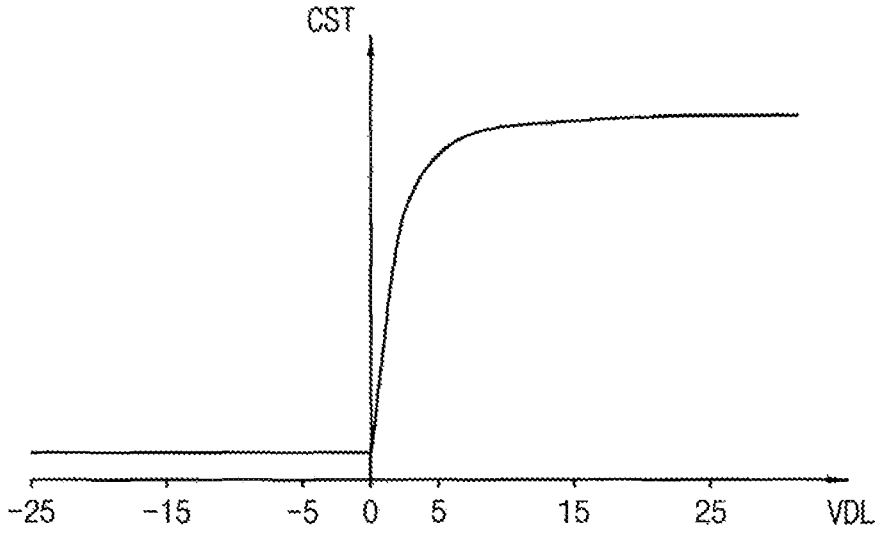
FIG. 4 is a graph illustrating a capacitance of a storage capacitor according to a difference between a storage voltage and a pixel voltage of FIG. 2.
Figure 5A:
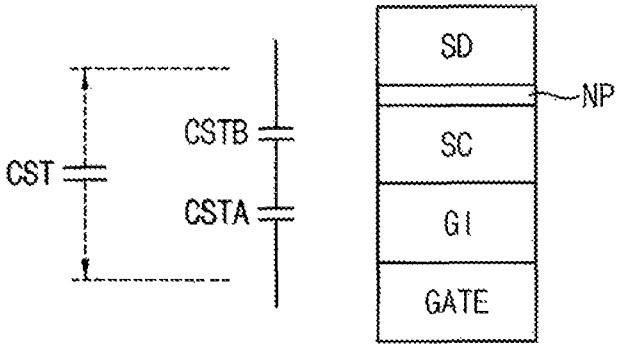
FIGS. 5A and 5B are cross-sectional diagrams illustrating example layers of a pixel and conceptual formation of the storage capacitor according to the difference between the storage voltage and the pixel voltage of FIG. 2.
Figure 5B:
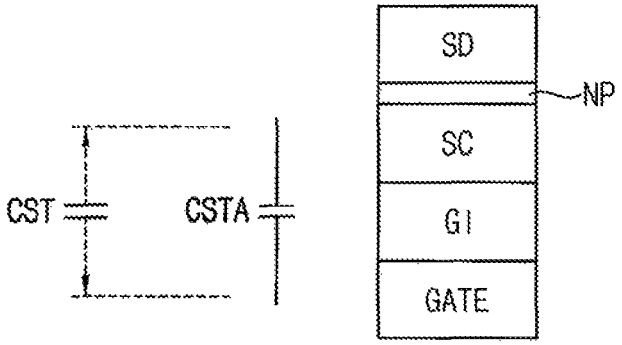

FIG. 4 is a graph illustrating a capacitance of the storage capacitor CST according to a difference between the storage voltage VCST and the pixel voltage VPX of FIG. 2. FIGS. 5A and 5B are cross-sectional diagrams illustrating example layers of a pixel PX and conceptual formation of the storage capacitor CST according to the difference between the storage voltage VCST and the pixel voltage VPX of FIG. 2.

Referring to FIGS. 1 to 5B, a capacitance of the storage capacitor CST may be defined by a delta voltage VDL which is a difference between the storage voltage VCST and the pixel voltage VPX.

In the present exemplary embodiment, the storage capacitor CST may be defined by the storage electrode SE, the pixel electrode PE and dielectric/semiconductor material therebetween. The storage electrode SE may be formed from a gate metal layer GATE including the gate line GL of the display panel 100. Note, however, that the storage electrode SE is not electrically connected to the gate line (the storage electrode SE is not tied to the potential of the gate line GL). The pixel electrode may contact a data metal layer SD.

In the display panel 100 which is manufactured by a four mask process, a gate insulating layer GI may be disposed on the gate metal layer GATE, a semiconductor layer SC may be disposed on the gate insulating layer GI, an N+ doped layer NP may be disposed on the semiconductor layer SC and the data metal layer SD may be disposed on the N+ doped layer NP. In FIGS. 5A and 5B, the storage electrode SE may be comprised of a portion of the GATE layer and the pixel electrode PE may be disposed on the data metal layer SD and electrically connected to the data metal layer SD.

The storage capacitor CST may be formed between the gate metal layer GATE and the data metal layer SD, in which case the pixel electrode PE is a part of the data metal layer SD. Alternatively, the storage capacitor CST may be formed between the gate metal layer GATE and the pixel electrode PE contacting the data metal layer SD (in this case the pixel electrode PE is not shown in FIG. 5A or 5B).

The delta voltage VDL is defined by subtracting the pixel voltage VPX from the storage voltage VCST. For example, the delta voltage VDL may be defined as the voltage across the storage capacitor CST, from the second end to the first end as depicted in FIG. 2.

When the delta voltage VDL is negative, the storage voltage VCST is less than the pixel voltage VPX. When the delta voltage VDL is negative, a first capacitance CSTA is formed at an area of the gate insulating layer GI and a second capacitance CSTB is formed at an area of the semiconductor layer SC as shown in FIG. 5A.

In contrast, when the delta voltage VDL is positive, the storage voltage VCST is greater than the pixel voltage VPX. When the delta voltage VDL is positive, the first capacitance CSTA is formed at an area of the gate insulating layer GI and no capacitance CSTB may be formed at an area of the semiconductor layer SC as shown in FIG. 5B.

According to the polarity of the delta voltage VDL, the capacitance of the storage capacitor CST may vary.

The capacitance of the storage capacitor CST, when the delta voltage VDL is negative, is less than the capacitance of the storage capacitor CST, when the data voltage VDL is positive, due to the combination of the first capacitance CSTA and the second capacitance CSTB.

For example, when the storage voltage VCST is 7.7V, an exemplary positive pixel voltage is 10V and an exemplary negative pixel voltage is 3V, the delta voltage VDL may be −2.3V for the exemplary positive pixel voltage and the delta voltage VDL may be 4.7V for the exemplary negative pixel voltage. The capacitance of the storage capacitor CST, when the delta voltage VDL is −2.3V, and the capacitance of the storage capacitor CST, when the delta voltage VDL is 4.7V may differ significantly.

The storage capacitor CST affects a kickback voltage VKB of the liquid crystal display panel 100. The kickback voltage VKB may be defined as Equation 1.

$$VKB = \frac{CGS}{CSI + CGS + CLC}(\Delta VG) \quad \text{[Equation 1]}$$

where, CGS is a capacitance between a gate electrode and a source electrode of the switching element TR, CLC is a capacitance of the liquid crystal capacitor and CST is the capacitance of the storage capacitor. ΔVG is a difference of gate voltages, such as a difference between a gate on voltage and a gate off voltage.

In the display panel 100 which is driven in an inversion method between a positive polarity and a negative polarity, the difference of the capacitance of the storage capacitor in the positive polarity vs. the negative polarity (i.e., the difference between the positive polarity and negative polarity driving conditions) generates a difference of the kickback voltage in the positive polarity vs. the negative polarity. This difference of the kickback voltage may be a primary reason for generating the difference of the luminance in the positive polarity vs. the negative polarity.

Figure 6A:
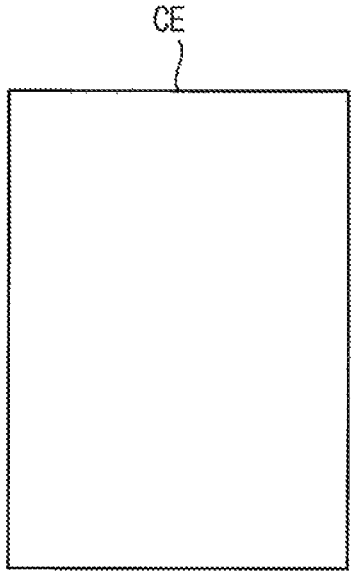
FIG. 6A is a plan view illustrating a common electrode of a display panel of FIG. 1.
Figure 6B:
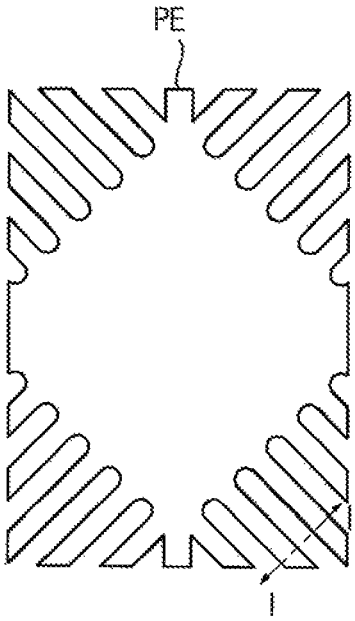
FIG. 6B is a conceptual diagram illustrating a pixel electrode of the display panel of FIG. 1.
Figure 7A:
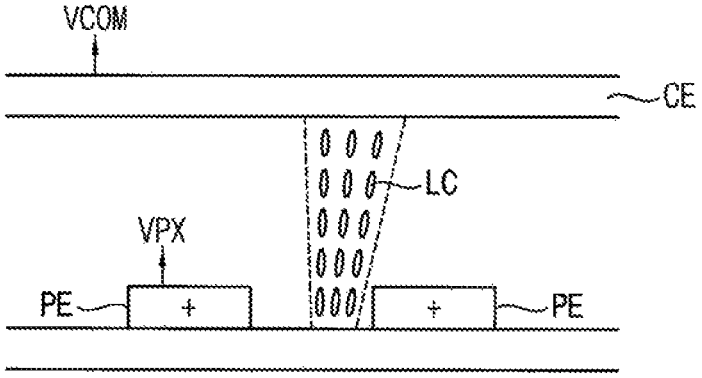
FIG. 7A is a conceptual diagram illustrating arrangements of liquid crystal molecules when a positive pixel voltage is applied to the pixel electrode of FIG. 6B.
Figure 7B:
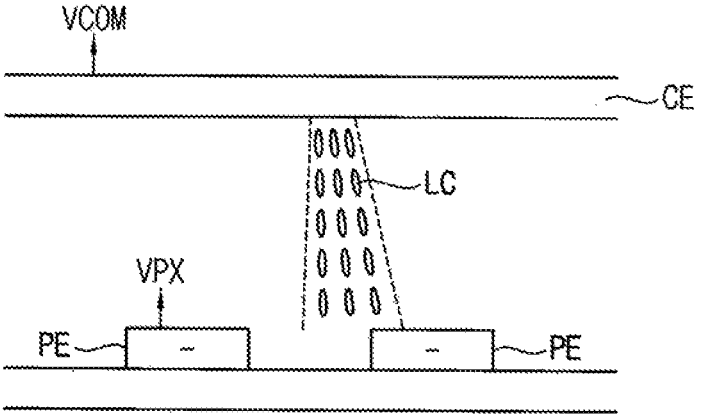
FIG. 7B is a conceptual diagram illustrating arrangements of the liquid crystal molecules when a negative pixel voltage is applied to the pixel electrode of FIG. 6B.

FIG. 6A is a plan view illustrating a common electrode CE of a display panel 100 of FIG. 1. FIG. 6B is a conceptual diagram illustrating a pixel electrode PE of the display panel 100 of FIG. 1. FIG. 7A is a conceptual diagram illustrating arrangements of liquid crystal molecules when a positive pixel voltage is applied to the pixel electrode PE of FIG. 6B. FIG. 7B is a conceptual diagram illustrating arrangements of the liquid crystal molecules when a negative pixel voltage is applied to the pixel electrode PE of FIG. 6B.

Referring collectively to FIGS. 1 to 7B, the pixel PX may include the common electrode CE and the pixel electrode PE facing each other and overlapping each other. In FIGS. 6A and 6B, the size of the common electrode CE and the size of the pixel electrode PE are represented as the same size for convenience of explanation. However, the common electrode CE may be formed to span an entire area of the display panel 100 while the pixel electrodes are individually patterned within each pixel PX.

The pixel electrode PE may include a specific pattern to arrange the liquid crystal molecules in a specific arrangement. For example, the pixel electrode PE may include a plurality of branches extending in diagonal directions, as shown in FIG. 6B.

The arrangement of the liquid crystal molecules may be affected by various components. For example, the liquid crystal molecules may be arranged to be dispersed in a direction from the pixel electrode PE to the common electrode CE or to be concentrated in the direction from the pixel electrode PE to the common electrode CE according to the polarity of the pixel voltage VPX applied to the pixel electrode PE. In addition, the change of the arrangement of the liquid crystal molecules may cause an unexpected increase or an unexpected decrease of the luminance.

FIG. 7A represents that the positive pixel voltage with respect to the common voltage is applied to the pixel electrodes PE. In FIG. 7A, the liquid crystal molecules in a portion of the liquid crystal layer may have a dispersed arrangement in the direction from the pixel electrode PE to the common electrode CE. For example, when the liquid crystal molecules in a portion of the liquid crystal layer has the dispersed arrangement in the direction from the pixel electrode PE to the common electrode CE, the luminance of the display panel 100 may increase due to a flexo-electric effect.

FIG. 7B represents that the negative pixel voltage with respect to the common voltage is applied to the pixel electrodes PE. In FIG. 7B, the liquid crystal molecules in a portion of the liquid crystal layer may have a concentrated arrangement in the direction from the pixel electrode PE to the common electrode CE. For example, when the liquid crystal molecules in a portion of the liquid crystal layer has the concentrated arrangement in the direction from the pixel electrode PE to the common electrode CE, the luminance of the display panel 100 may decrease due to the flexo-electric effect.

As explained above, the arrangement of the liquid crystal molecules according to the flexo-electric effect may be a component generating the difference of the luminance in the positive polarity vs. the negative polarity driving conditions.

Figure 8:
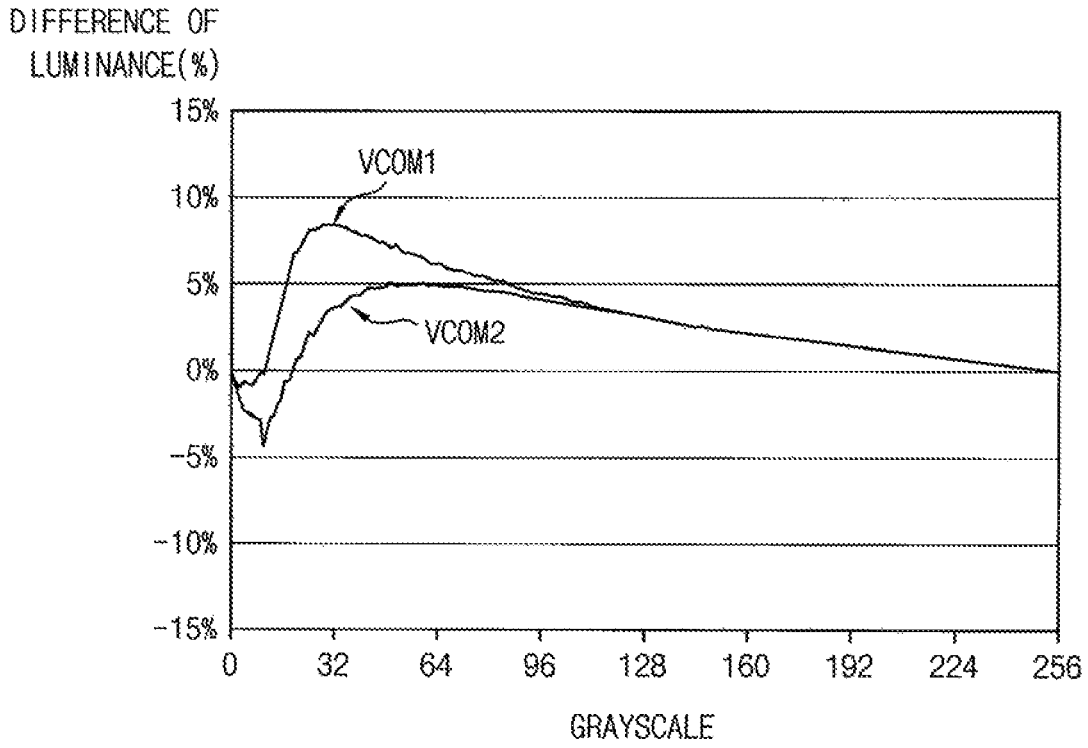
FIG. 8 is a graph illustrating a difference of luminance of the display panel of FIG. 1 according to a grayscale value of the input image data and a common voltage.

FIG. 8 is a graph illustrating the difference of the luminance of the display panel 100 of FIG. 1 according to a grayscale value of the input image data IMG and the common voltage VCOM. The graph illustrates the difference in luminance in % terms, in the positive polarity vs. the negative polarity conditions, for two different VCOM voltages VCOM1, VCOM2 applied to a pixel, as a function of grayscale value applied to the pixel.

In a polarity inversion driving method, liquid crystals are driven with an alternating current to prevent deterioration of image quality resulting from DC stress. Polarity inversion may be implemented with a frame-reversal drive method in which the voltage applied to each pixel varies from frame to frame; an H-line inversion method in which polarity is inverted line to line; and/or a dot inversion method in which polarity is inverted in both column and row directions. As explained referring to FIGS. 4 to 7B, the difference of the luminance in the positive polarity vs. the negative polarity may be easily discernible to a viewer as a display defect when the display panel 100 is driven with a variable frame rate FR. Thus, in related art displays, the difference of the luminance in the positive polarity vs. the negative polarity may be a primary reason for deterioration in display quality of the display panel 100 supporting the variable frame rate FR.

As illustrated in FIG. 8, when a level of the common voltage VCOM is adjusted in accordance with the inventive concept, the difference of the luminance in the positive polarity vs. the negative polarity may be reduced. As an example, a first common voltage VCOM1 may be a flicker optimized common voltage to minimize a flicker of a mid-range grayscale value (herein, a mid-range grayscale value is about half of an entire range from a minimum to maximum grayscale values, such as about 128 grayscale in a range of 0-255 grayscale). For example, a second common voltage VCOM2 may be less than the first common voltage VCOM1. As the graph illustrates, the difference of the luminance in the positive polarity vs. the negative polarity decreases for the second common voltage VCOM2 for grayscale values above about 10 (out of 255).

The difference of the luminance in the positive polarity vs. the negative polarity may vary according to the grayscale value of the input image data IMG. The difference of the luminance in the positive polarity vs. the negative polarity may be greater in a low grayscale value area compared to in a high grayscale value area. The example of FIG. 8 shows that a lower overall luminance difference may be achieved by applying the voltage VCOM1 for grayscale values below about 10 (out of 255) and applying voltage VCOM2 for higher grayscale values. For example, the VCOM value may be determined and varied from frame to frame, or between sequential groups of frames, by determining an average grayscale value beforehand for a current frame or group of frames to be displayed and setting an optimum VCOM value for the frame or group of frames accordingly.

Figure 9:
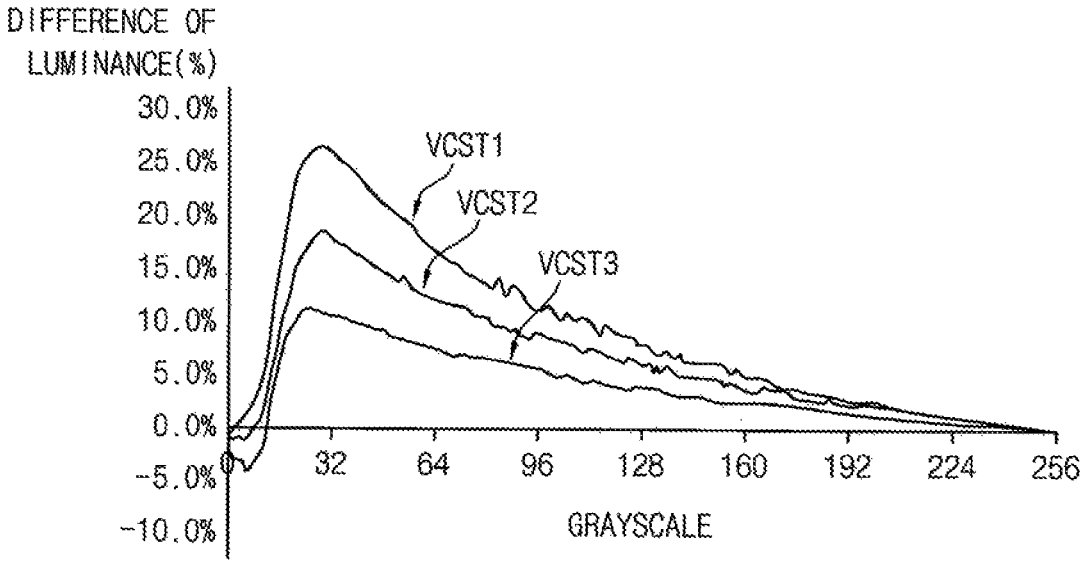
FIG. 9 is a graph illustrating a difference of luminance of the display panel of FIG. 1 according to the grayscale value of the input image data and the storage voltage.
Figure 10:
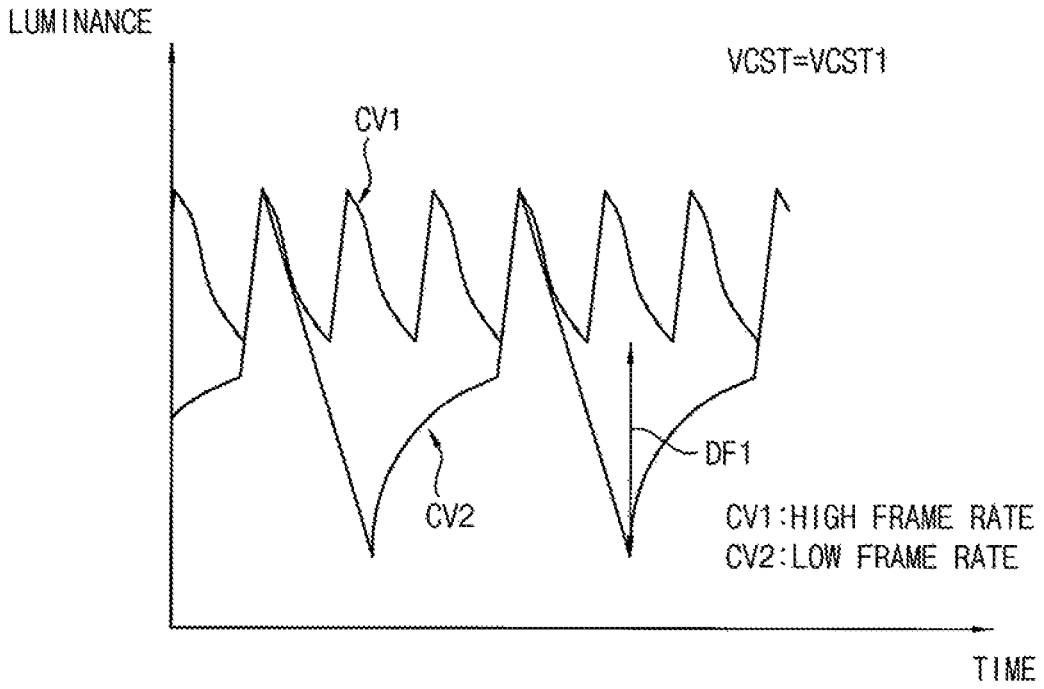
FIG. 10 is a graph illustrating a luminance of an image in a low frame rate and a luminance of an image in a high frame rate when the storage voltage is a first storage voltage of FIG. 9.
Figure 11:
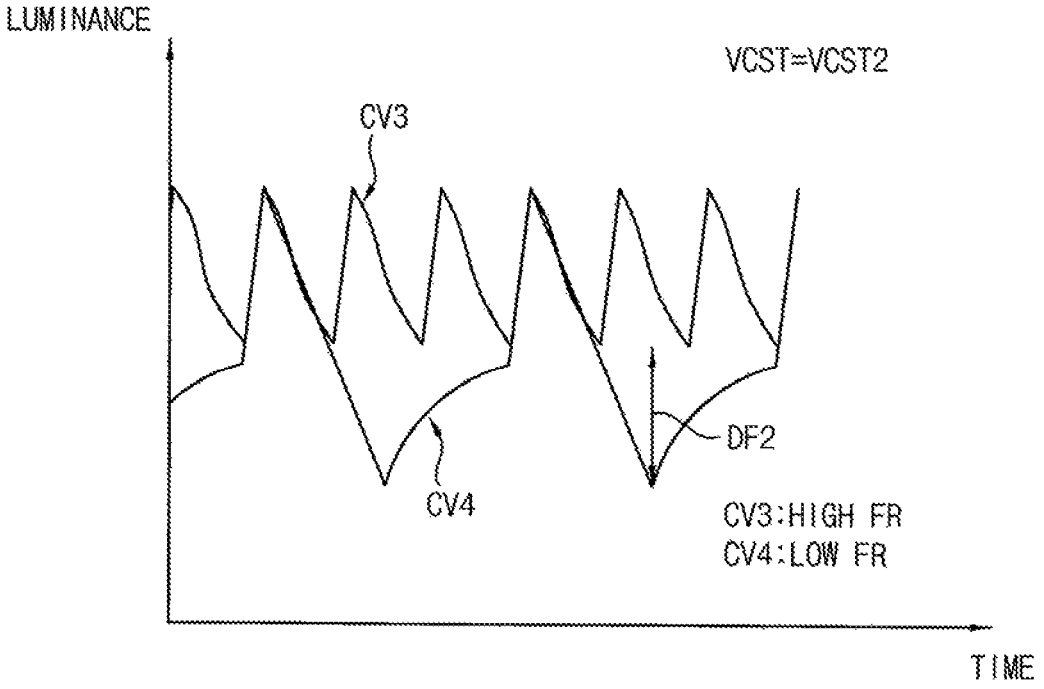
FIG. 11 is a graph illustrating a luminance of an image in a low frame rate and a luminance of an image in a high frame rate when the storage voltage is a second storage voltage of FIG. 9.
Figure 12:
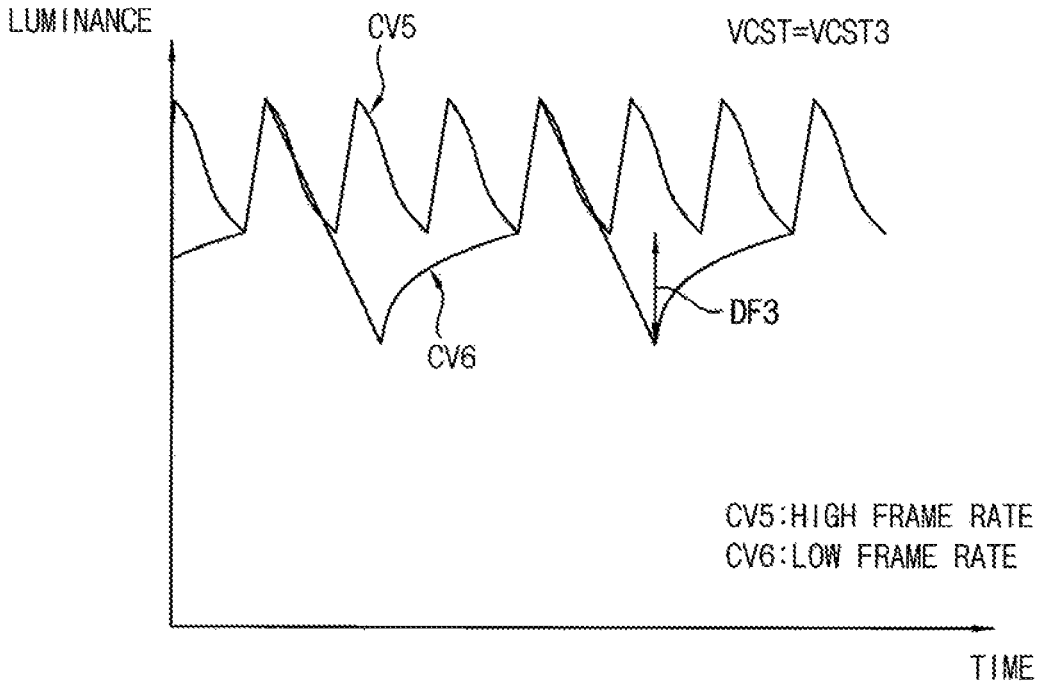
FIG. 12 is a graph illustrating a luminance of an image in a low frame rate and a luminance of an image in a high frame rate when the storage voltage is a third storage voltage of FIG. 9.

FIG. 9 is a graph illustrating the difference of the luminance of the display panel 100 of FIG. 1 according to the grayscale value of the input image data IMG and the storage voltage VCST. FIG. 10 is a graph illustrating a luminance of an image in a low frame rate and a luminance of an image in a high frame rate when the storage voltage VCST is a first storage voltage VCST1 of FIG. 9. FIG. 11 is a graph illustrating a luminance of an image in a low frame rate and a luminance of an image in a high frame rate when the storage voltage VCST is a second storage voltage VCST2 of FIG. 9. FIG. 12 is a graph illustrating a luminance of an image in a low frame rate and a luminance of an image in a high frame rate when the storage voltage VCST is a third storage voltage VCST3 of FIG. 9.

As illustrated in FIGS. 9 to 12, when a level of the storage voltage VCST is adjusted, the difference of the luminance in the positive polarity vs. the negative polarity may be reduced.

For example, the second storage voltage VCST2 may be a storage voltage generally used to drive the display panel 100. For example, the second storage voltage VCST2 may be about 7.7V.

The first storage voltage VCST1 may be less than the second storage voltage VCST2. For example, the first storage voltage VCST1 may be about 2.6V.

The third storage voltage VCST3 may be greater than the second storage voltage VCST2. For example, the third storage voltage VCST3 may be about 12.6V.

As shown in FIG. 9, the difference of the luminance in the positive polarity vs. the negative polarity is higher for the first storage voltage VCST1 as compared to that of the second storage voltage VCST2, over a majority of the grayscale range (up to a grayscale value of about 170).

The difference of the luminance in the positive polarity vs. the negative polarity decreases for the third storage voltage VCST3 as compared to the second storage voltage VCST2, for grayscale values higher than about 8.

For example, when the storage voltage VCST is 7.7V, an exemplary positive pixel voltage is 10V and an exemplary negative pixel voltage is 3V, the delta voltage VDL may be −2.3V for the exemplary positive pixel voltage and the delta voltage VDL may be 4.7V for the exemplary negative pixel voltage. As shown in FIG. 4, the capacitance of the storage capacitor CST, when the delta voltage VDL is −2.3V, and the capacitance of the storage capacitor CST, when the delta voltage VDL is 4.7V may differ significantly.

For example, when the storage voltage VCST is 12.6V, an exemplary positive pixel voltage is 10V and an exemplary negative pixel voltage is 3V, the delta voltage VDL may be 2.6V for the exemplary positive pixel voltage and the delta voltage VDL may be 9.6V for the exemplary negative pixel voltage. As shown in FIG. 4, the difference between the capacitance of the storage capacitor CST, when the delta voltage VDL is 2.6V, and the capacitance of the storage capacitor CST, when the delta voltage VDL is 9.6V may decrease compared to the difference of the capacitance of the storage capacitor CST in the positive polarity and the negative polarity for the storage voltage VCST of 7.7V. When the difference of the capacitance of the storage capacitor CST in the positive polarity and the negative polarity decreases, the difference of the luminance in the positive polarity and the negative polarity may be reduced.

As a result, the storage voltage VCST may be greater than the common voltage VCOM in the present exemplary embodiment. As an example, the storage voltage VCST may be set to be about twice the common voltage VCOM for any given frame.

In the present exemplary embodiment, the common voltage VCOM and the storage voltage VCST may have DC levels which are uniform levels according to time (e.g. uniform throughout a frame or throughout a group of frames).

Alternatively, the common voltage VCOM and the storage voltage VCST may vary according to time.

For example, the voltage generator 600 may generate the common voltage VCOM varied according to the grayscale value of the input image data IMG. The voltage generator 600 may output the common voltage VCOM varied according to the grayscale value of the input image data IMG substantially in real time to the display panel 100.

As shown in FIG. 8, the difference of the luminance in the positive polarity and the negative polarity may be greater in the low grayscale value area compared to in the high grayscale value area so that the average common voltage VCOM for the low grayscale value area of the input image data IMG may be less than the average common voltage VCOM for the high grayscale value area of the input image data IMG. The low grayscale value area may be defined as an area between a minimum grayscale value (e.g. zero grayscale or grayscale value in a range from zero to about 8, 10 or 16) and a mid-range grayscale value (e.g. about 128 grayscale). The high grayscale value area may be defined as an area between the mid-range grayscale value (e.g. 128 grayscale) and a maximum grayscale value (e.g. 255 grayscale).

In the present exemplary embodiment, the voltage generator 600 may generate the common voltage VCOM varied according to an average grayscale value of the input image data IMG in a frame. The voltage generator 600 may output the common voltage VCOM which may be set differently for every frame, to the display panel 100. The same common voltage VCOM may be applied to all or substantially all the pixels PX of the display panel 100 throughout the duration of a frame. Likewise, the same storage voltage VCST may be applied to all or substantially all the pixels PX throughout the duration of a frame.

For example, the voltage generator 600 may generate the storage voltage VCST varied according to the grayscale value of the input image data IMG. The voltage generator 600 may output the storage voltage VCST varied according to the grayscale value of the input image data IMG in real time to the display panel 100.

As shown in FIG. 9, the difference of the luminance in the positive polarity vs. the negative polarity may be greater in the low grayscale value area compared to that in the high grayscale value area. As such, the average storage voltage VCST for the low grayscale value area of the input image data IMG (e.g., frames having a low average grayscale value) may be set greater than the average storage voltage VCST for the high grayscale value area of the input image data IMG (e.g. frames having a high average grayscale value).

In the present exemplary embodiment, the voltage generator 600 may generate the storage voltage VCST varied on an inter-frame basis (or varied between groups of frames), according to an average grayscale value of the input image data IMG in a frame (or group of frames). The voltage generator 600 may output the storage voltage VCST which is varied from frame to frame to the display panel 100. For instance, the voltage generator 600 may have a processor configured to receive an entire frame's worth of image data and compute an average grayscale value for the frame. The voltage generator 600 may then set the voltages VCOM and VCST optimally for that frame. The timing controller 200 may delay the output of image data and control signals to the data driver 500 and gamma reference voltage generator by at least one frame so that the voltage generator 600 may synchronize the provision of the voltages VCOM and VCST with the corresponding data line voltages output by the data driver 500 to the display panel 100. Alternatively, to avoid such a delay, an average gray scale value for each frame may be computed by timing controller 200 or by an external device (e.g. by the GPU) and provided to timing controller 200 as additional data, which in either case may then be provided to voltage generator 600.

FIG. 10 is a graph illustrating a luminance of an image in a low frame rate and a luminance of the image in a high frame rate for the first storage voltage VCST1 (2.6V). The average gray scale value is about the same for the low frame rate and high frame rate conditions. For the first storage voltage VCST1 (2.6V), the luminance of the image in the high frame rate swings along a first curve CV1 and the luminance of the image in the low frame rate swings along a second curve CV2. A difference between a minimum luminance of the first curve CV1 and a minimum luminance of the second curve CV2 is represented as a first luminance difference DF1. A zig-zag pattern in the luminance in each of the curves CV1 and CV2 may be due to polarity inversion from frame to frame. The difference in luminance due to polarity is higher for the low frame rate frames than for the high frame rate frames. It is seen that while the peak levels of luminance are about the same for the low frame rate frames and the high frame rate frames, the nulls in luminance are significantly lower for the low frame rate frames.

FIG. 11 is a graph illustrating a luminance of an image in a low frame rate and a luminance of the image in a high frame rate for the second storage voltage VCST2 (7.7V) (with average grayscale values about the same for the low and high frame rate conditions). For the second storage voltage VCST2 (7.7V), the luminance of the image in the high frame rate swings along a third curve CV3 and the luminance of the image in the low frame rate swings along a fourth curve CV4. A difference between a minimum luminance of the third curve CV3 and a minimum luminance of the fourth curve CV4 is represented as a second luminance difference DF2.

FIG. 12 is a graph illustrating a luminance of an image in a low frame rate and a luminance of the image in a high frame rate for the third storage voltage VCST3 (12.6V). Average grayscale values are about the same for the low and high frame rate conditions. For the third storage voltage VCST3 (12.6V), the luminance of the image in the high frame rate swings along a fifth curve CV5 and the luminance of the image in the low frame rate swings along a sixth curve CV6. A difference between a minimum luminance of the fifth curve CV5 and a minimum luminance of the sixth curve CV6 is represented as a third luminance difference DF3.

When the first storage voltage VCST1 less than the second storage voltage VCST2 is applied to the display panel 100, the first luminance difference DF1 is greater than the second luminance difference DF2. As a result, the luminance characteristic of the display panel 100 may deteriorate in the variable frame rate (relative to the case of applying the second storage voltage VCST2) when the first storage voltage VCST1 is applied.

When the third storage voltage VCST3 greater than the second storage voltage VCST2 is applied to the display panel 100, the third luminance difference DF3 is less than the second luminance difference DF2. In this case, the luminance characteristic of the display panel 100 may be enhanced in the variable frame rate (relative to the case of applying the second storage voltage VCST2).

According to the present exemplary embodiment, the image is displayed using the storage voltage VCST which is greater than the common voltage VCOM, which may result in a reduction in the display defect due to the variable frame rate.

Additionally or alternatively, the common voltage VCOM may be set with a varied value from frame to frame according to a grayscale value of the input image data IMG from frame to frame (as discussed for FIG. 8). By varying the common voltage VCOM in this manner, the display defect due to the variable frame rate may be compensated.

Thus, the display quality of the display panel 100 displaying the image in the variable frame rate may be enhanced.

In an alternative embodiment, instead of varying the common voltage VCOM on a frame to frame or frame group to frame group basis, it may be varied within a frame according to grayscale voltages on a region to region basis. In another embodiment, instead of always setting the storage voltage VCST higher than the common voltage VCOM, it may be selectively set higher, or set equal, from frame to frame or for different regions of the same frame. Such selection may be based on grayscale values, and the selection may serve to minimize luminance differences due to polarity inversion.

Figure 13:
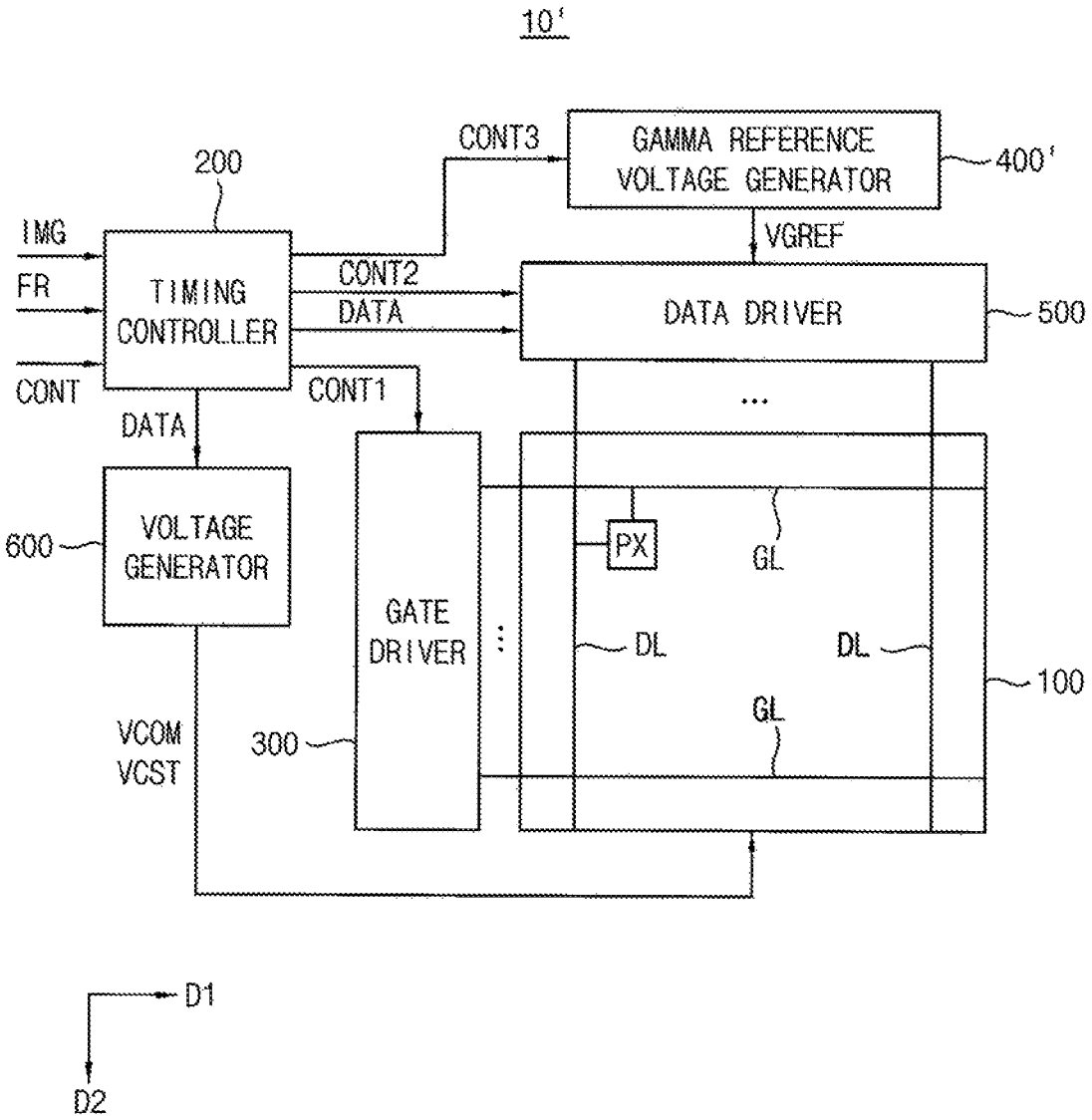
FIG. 13 is a block diagram illustrating a display apparatus according to an exemplary embodiment of the present inventive concept.
Figure 14:
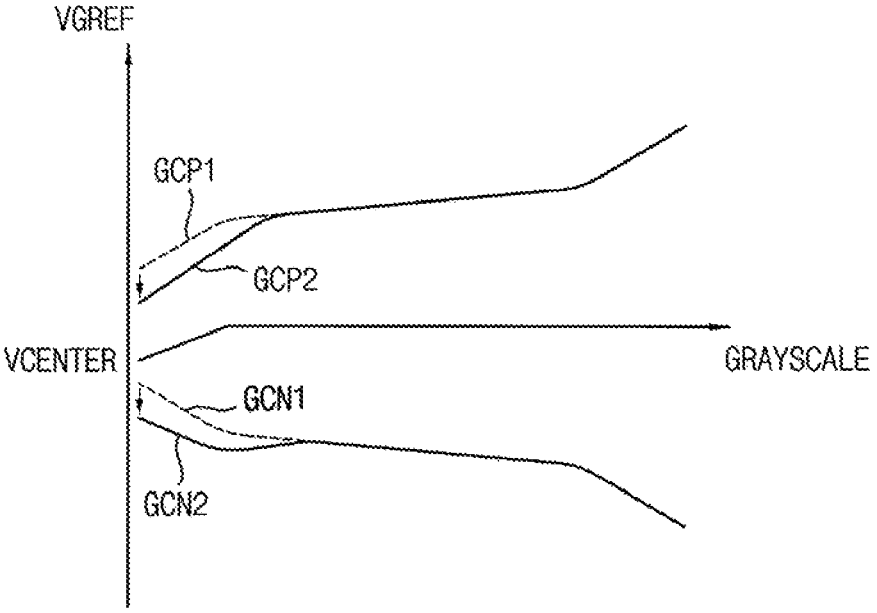
FIG. 14 is a graph illustrating a gamma reference voltage of FIG. 13 according to the grayscale value.

FIG. 13 is a block diagram illustrating a display apparatus, 10', according to an exemplary embodiment of the present inventive concept. FIG. 14 is a graph illustrating a gamma reference voltage of display apparatus 10' according to the grayscale value.

The display apparatus 10' differs from the display apparatus 10 described above by substituting a gamma reference voltage generator 400' that outputs different gamma reference voltages than those of the gamma reference voltage generator 400. Otherwise, the same reference numerals will be used to refer to the same or like parts as those described in the previous exemplary embodiment of FIGS. 1 to 12 and redundant explanation concerning the above elements will be omitted.

Referring to FIGS. 13 and 14, the display apparatus includes a display panel 100 and a display panel driver. The display panel driver includes a timing controller 200, a gate driver 300, the gamma reference voltage generator 400', a data driver 500 and a voltage generator 600.

The timing controller 200 generates a first control signal CONT1, a second control signal CONT2, a third control signal CONT3 and a data signal DATA based on the input image data IMG, the frame rate FR and the input control signal CONT.

The gamma reference voltage generator 400' generates a gamma reference voltage VGREF in response to the third control signal CONT3 received from the timing controller 200, and outputs voltage VGREF to the data driver 500. The gamma reference voltage VGREF has a value corresponding to a level of the data signal DATA.

The gamma reference voltage generator 400' may generate a positive gamma reference voltage and a negative gamma reference voltage such that an average of the positive gamma reference voltage and the negative gamma reference voltage is a center voltage VCENTER for the same grayscale value.

The gamma reference voltage generator 400' may generate the positive gamma reference voltage and the negative gamma reference voltage based on the center voltage VCENTER varied according to the grayscale value of the input image data IMG. The level of the center voltage VCENTER may be decreased in the low grayscale value area, e.g., which decreases linearly below a threshold grayscale value.

If a conventional gamma reference curve to generate positive gamma reference voltages is GCP1, the positive gamma reference voltages may be generated using a gamma reference curve GCP2 which has a decreased level in the low grayscale value area compared to GCP1 in the present exemplary embodiment.

If a conventional gamma reference curve to generate negative gamma reference voltages is GCN1, the negative gamma reference voltages may be generated using a gamma reference curve GCN2 which has a decreased level in the low grayscale value area compared to GCN1 in the present exemplary embodiment.

For example, a first average of the center voltage VCENTER, when a grayscale value is between a minimum grayscale value and a mid-range grayscale value, may be less than a second average of the center voltage VCENTER, when a grayscale value is between the mid-range grayscale value and a maximum grayscale value.

The voltage generator 600 generates a common voltage VCOM and a storage voltage VCST. The voltage generator 600 outputs the common voltage VCOM and the storage voltage VCST to the display panel 100. The voltage generator 600 may generate the common voltage VCOM and the storage voltage VCST using the data signal DATA. For example, the storage voltage VCST may be greater than the common voltage VCOM in the present exemplary embodiment. As an example, the storage voltage VCST may be set to be about twice the common voltage VCOM during an arbitrary frame.

According to the present exemplary embodiment of display apparatus 10', in addition to the above gamma reference voltage compensation, the image may be displayed using the storage voltage VCST which is greater than the common voltage VCOM so that the display defect due to the variable frame rate may be compensated.

In addition, the common voltage VCOM may have a varied value according to a grayscale value of the input image data IMG so that the display defect due to the variable frame rate may be compensated.

Thus, the display quality of the display panel 100 displaying the image at the variable frame rate may be enhanced.

Figure 15:
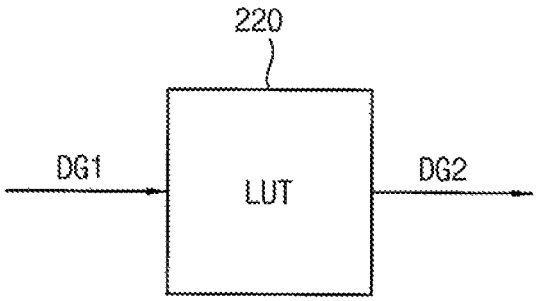
FIG. 15 is a block diagram illustrating a data signal converter included in a timing controller of a display apparatus according to an exemplary embodiment of the present inventive concept.

FIG. 15 is a block diagram illustrating a data signal converter included in a timing controller of a display apparatus according to an exemplary embodiment of the present inventive concept.

The display apparatus according to this embodiment is substantially the same as the display apparatus of the previous exemplary embodiment explained referring to FIGS. 13 and 14 except that the grayscale value of the data signal is compensated instead of adjusting the gamma reference voltage. Note that the configuration of display apparatus 10 of FIG. 1 with gamma reference voltage generator 400 may be assumed for the presently described embodiment. In the following discussion, gamma reference voltage generator 400 is assumed to conventionally output the gamma reference voltage VGREF according to gamma curves GCP1 and GCN1 in FIG. 14. However, using a data signal converter 220 within timing controller 200, gamma reference voltages according to gamma curves GCP2 and GCN2 may be output.

In this embodiment, the timing controller 200 includes data signal converter 220 to compensate the grayscale value of the data signal. For example, the data signal converter 220 may include a lookup table (LUT). Timing controller 200 generates a first control signal CONT1, a second control signal CONT2, a third control signal CONT3 and a data signal DATA based on the input image data IMG, the frame rate FR and the input control signal CONT.

The data signal converter 220 receives a first grayscale value DG1 and outputs a second grayscale value DG2. For example, the data signal converter 220 adds a variable frame compensating signal to the first grayscale value DG1 to generate the second grayscale value DG2.

The variable frame compensating signal may be negative. For example, when the first grayscale value DG1 is 32 grayscale, and the variable frame compensating signal is −5 grayscale, the second grayscale value DG2 may be 27 grayscale.

The data signal converter 220 operates data conversion like the gamma curve conversion as explained in FIG. 14 without changing the gamma curve. For example, in the present exemplary embodiment including data signal converter 220, the gamma reference voltage generator 400 generates the gamma reference voltages using the gamma curves GCP1 and GCN1 in FIG. 14, but because of the data conversion by data signal converter 220, the input grayscale values are converted so that the data voltages having the same values as the data voltages using the gamma curves GCP2 and GCN2 in FIG. 14 are outputted to the display panel 100.

The variable frame compensation due to LUT 220 may be higher (and may be more beneficial) in the low grayscale value area. For example, a first average of an absolute value of the variable frame compensation signal, when a grayscale value is between a minimum grayscale value and a mid-range grayscale value, may be greater than a second average of the absolute value of the variable frame compensation signal, when a grayscale value is between the mid-range grayscale value and a maximum grayscale value.

The voltage generator 600 generates a common voltage VCOM and a storage voltage VCST. The voltage generator 600 outputs the common voltage VCOM and the storage voltage VCST to the display panel 100. The voltage generator 600 may generate the common voltage VCOM and the storage voltage VCST using the data signal DATA. For example, the storage voltage VCST may be greater than the common voltage VCOM in the present exemplary embodiment. As an example, the storage voltage VCST may be set to be about twice the common voltage VCOM.

In the above-described embodiments, various elements may be embodied as hardware circuitry, which may include at least one processor and memory. If a processor is included (such as in timing controller 200 to retrieve look up table values, or in voltage generator 600 to compute an average gray scale value for a frame or for a group of frames), the processor may read instructions from the memory to execute a routine for executing one or more of the above-described operations.

For example, timing controller 200, voltage generator 600, gamma reference voltage generator 400 or 400', data driver 500 and gate driver 300 may alternatively be called a timing controller circuit, a voltage generator circuit, a gamma reference voltage generator circuit, a data driver circuit, and a gate driver circuit, or the like, respectively.

According to the present exemplary embodiment, the image is displayed using the storage voltage VCST which is greater than the common voltage VCOM, thereby reducing or eliminating the display defect due to a variable frame rate in a video.

In addition, the common voltage VCOM has a varied value according to a grayscale value of the input image data IMG, such as on a frame to frame basis, thereby reducing or obviating a display defect due to the variable frame rate.

Thus, the display quality of the display panel 100 displaying images at a variable frame rate may be enhanced.

According to the exemplary embodiments of the display apparatus and the method of driving the display panel, the display defect due to the variable frame rate is compensated, whereby display quality of the display panel may be enhanced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined by the appended claims and their equivalents.

What is claimed is:

1. A display apparatus comprising:

a display panel comprising: a switching element; a pixel electrode connected to the switching element; a common electrode; and a storage electrode, wherein the pixel electrode overlaps both the common electrode and the storage electrode in a common direction;

a timing controller configured to process input image data according to a variable frame rate and generate therefrom a data signal having a variable frame length;

a data driver configured to convert the data signal into a data voltage and output the data voltage to a data line connected to the switching element; and a voltage generator configured to apply a common voltage to the common electrode and a storage voltage greater than the common voltage to the storage electrode;

wherein the voltage generator generates the common voltage having a first average value when the grayscale value of the input image data is between a minimum grayscale value and a mid-range grayscale value, and having a second, higher average value when the grayscale value of the input image data is between the mid-range grayscale value and a maximum grayscale value.

2. The display apparatus of claim 1, wherein the data signal includes an active period and a blank period, and wherein the timing controller adjusts a length of the blank period of the data signal according to the variable frame rate.

3. The display apparatus of claim 2, wherein the timing controller generates a first frame data signal including a first active period and a first blank period corresponding to a first frame rate, and wherein the timing controller generates a second frame data signal including a second active period having a length equal to a length of the first active period and a second blank period having a length less than a length of the first blank period corresponding to a second frame rate greater than the first frame rate.

4. The display apparatus of claim 1, wherein the storage voltage is about twice of the common voltage.

5. The display apparatus of claim 1, wherein the voltage generator generates the common voltage varied on a frame by frame basis according to an average of the grayscale value of the input image data in a frame.

6. The display apparatus of claim 1, wherein the voltage generator generates the storage voltage varied according to a grayscale value of the input image data.

7. The display apparatus of claim 6, wherein the voltage generator generates the storage voltage varied on a frame by frame basis according to an average of the grayscale value of the input image data in a frame.

8. The display apparatus of claim 1, wherein the timing controller generates a variable frame compensation signal varied according to the grayscale value of the input image data, and wherein the timing controller adds the variable frame compensation signal to the grayscale value of the input image data.

9. The display apparatus of claim 8, further comprising a gamma reference voltage generator, wherein the input image data with the variable frame compensation signal added to the grayscale value thereof is output to the gamma reference voltage generator.

10. The display apparatus of claim 8, wherein the variable frame compensation signal has a negative value, and wherein a first average of an absolute value of the variable frame compensation signal, when the grayscale value is between a minimum grayscale value and a mid-range grayscale value, is greater than a second average of the absolute value of the variable frame compensation signal, when the grayscale value is between the mid-range grayscale value and a maximum grayscale value.

11. A display apparatus comprising:

a display panel comprising: a switching element; a pixel electrode connected to the switching element; a common electrode; and a storage electrode, wherein the pixel electrode overlaps both the common electrode and the storage electrode in a common direction;

a timing controller configured to process input image data according to a variable frame rate and generate therefrom a data signal having a variable frame length;

a data driver configured to convert the data signal into a data voltage and output the data voltage to a data line connected to the switching element; and a voltage generator configured to apply a common voltage to the common electrode and a storage voltage greater than the common voltage to the storage electrode;

wherein the voltage generator generates the storage voltage varied according to a grayscale value of the input image data, and wherein a first average of the storage voltage, when the grayscale value of the input image data is between a minimum grayscale value and a mid-range grayscale value, is greater than a second average of the storage voltage, when the grayscale value of the input image data is between the mid-range grayscale value and a maximum grayscale value.

12. A display apparatus comprising:

a display panel comprising: a switching element; a pixel electrode connected to the switching element; a common electrode; and a storage electrode, wherein the pixel electrode overlaps both the common electrode and the storage electrode in a common direction;

a timing controller configured to process input image data according to a variable frame rate and generate therefrom a data signal having a variable frame length;

a data driver configured to convert the data signal into a data voltage and output the data voltage to a data line connected to the switching element;

a voltage generator configured to apply a common voltage to the common electrode and a storage voltage greater than the common voltage to the storage electrode; and a gamma reference voltage generator configured to generate a gamma reference voltage having a value corresponding to a level of the data signal, wherein the gamma reference voltage generator generates a positive gamma reference voltage and a negative gamma reference voltage such that an average of the positive gamma reference voltage and the negative gamma reference voltage is a center voltage for the same grayscale value, and wherein the gamma reference voltage generator generates the positive gamma reference voltage and the negative gamma reference voltage based on the center voltage varied according to a grayscale value of the input image data.

13. The display apparatus of claim 12, wherein a first average of the center voltage, when the grayscale value is between a minimum grayscale value and a mid-range grayscale value, is less than a second average of the center voltage, when the grayscale value is between the mid-range grayscale value and a maximum grayscale value.

14. A display apparatus comprising:

a display panel comprising a switching element, a pixel electrode connected to the switching element and a common electrode having a major surface overlapping a major surface of the pixel electrode;

a timing controller configured to process input image data according to a variable frame rate and to generate a data signal therefrom having a variable frame length;

a data driver configured to convert the data signal into a data voltage and to output the data voltage to a data line connected to the switching element; and a voltage generator configured to apply a common voltage varied according to a grayscale value of the input image data to the common electrode;

wherein the voltage generator applies the common voltage having a first average value when the grayscale value of the input image data is between a minimum grayscale value and a mid-range grayscale value, and having a second, higher average value when the grayscale value of the input image data is between the mid-range grayscale value and a maximum grayscale value.

15. The display apparatus of claim 14, wherein the voltage generator generates the common voltage varied on a frame by frame basis according to an average of the grayscale value of the input image data in a frame.

16. The display apparatus of claim 14, wherein the voltage generator is further configured to compute an average grayscale value of the input image data in the frame.

17. A method of driving a display panel, the method comprising:

processing input image data according to a variable frame rate and generating a data signal having a variable frame length;

converting the data signal into a data voltage and outputting the data voltage to a pixel electrode of the display panel via a data line and a switching element;

applying a common voltage to a common electrode of the display panel, the common voltage having a first average value when the grayscale value of the input image data is between a minimum grayscale value and a mid-range grayscale value, and having a second, higher average value when the grayscale value of the input image data is between the mid-range grayscale value and a maximum grayscale value; and applying a storage voltage greater than the common voltage to a storage electrode of the display panel.

18. The method of claim 17, wherein the data signal includes an active period and a blank period, and wherein the generating the data signal comprises adjusting a length of the blank period of the data signal according to the variable frame rate.

19. The method of claim 18, wherein the generating the data signal comprises:

generating a first frame data signal including a first active period and a first blank period corresponding to a first frame rate; and generating a second frame data signal including a second active period having a length equal to a length of the first active period and a second blank period having a length less than a length of the first blank period corresponding to a second frame rate greater than the first frame rate.

20. The method of claim 17, wherein the storage voltage is about twice the common voltage.

21. The method of claim 17, further comprising:

computing an average grayscale value of a frame to be displayed; and setting the common voltage for the frame according to the average grayscale value, wherein the common voltage is set to a value sufficient to reduce a difference in luminance according to the average grayscale value, generated in positive polarity vs. negative polarity driving conditions.

22. The method of claim 17, further comprising:

computing an average grayscale value of a frame to be displayed; and setting the storage voltage for the frame according to the average grayscale value, wherein the storage voltage is set to a value sufficient to reduce a difference in luminance, according to the average grayscale value, generated in positive polarity vs. negative polarity driving conditions.

23. The method of claim 17, wherein the storage voltage is applied at a value sufficient to minimize a luminance difference between frames of different frame lengths.

* * * * *